United States Patent [19]

Waegaert et al.

[11] 4,262,681

[45] Apr. 21, 1981

[54] WRAPPER DISTRIBUTING SUPPORT BAND FOR THE MANUFACTURE OF CIGARS

[75] Inventors: Pierre Waegaert, Bordeaux; Jean-Claude Battard, Saran, both of France

[73] Assignee: Service d'Exploitation Industrielle des Tabacs et des Allumettes, Paris, France

[21] Appl. No.: 113,260

[22] Filed: Jan. 18, 1980

Related U.S. Application Data

[63] Continuation of Ser. No. 897,672, Apr. 19, 1978, abandoned.

[30] Foreign Application Priority Data

Apr. 20, 1977 [FR] France ..... 77 11809
Nov. 18, 1977 [FR] France ..... 77 34680

[51] Int. Cl.[3] ..... A24C 1/28
[52] U.S. Cl. ..... 131/105
[58] Field of Search ..... 131/105, 125, 149; 206/459; 198/356

[56] References Cited

U.S. PATENT DOCUMENTS

| | | | |
|---|---|---|---|
| 3,542,038 | 11/1970 | Hooper et al. | 131/105 X |
| 3,743,090 | 7/1973 | Brown et al. | 198/356 X |
| 3,955,500 | 5/1976 | Mahoney et al. | 101/111 |

*Primary Examiner*—Stephen C. Pellegrino
*Attorney, Agent, or Firm*—Holman & Stern

[57] ABSTRACT

A wrapper distributing support band for the manufacture of cigars or similar products, wherein the "right" wrappers present a face of the tobacco leaf which is the reverse to that presented by the "left" wrappers.

11 Claims, 1 Drawing Figure

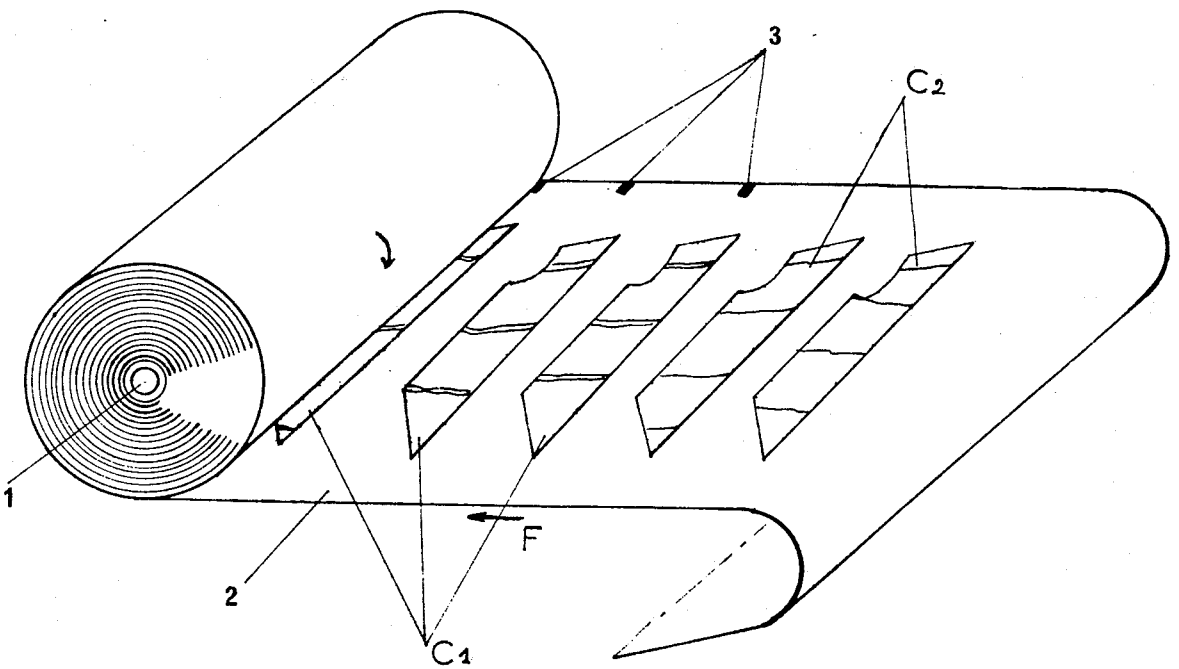
C2
3
F
C1
2
1

WRAPPER DISTRIBUTING SUPPORT BAND FOR THE MANUFACTURE OF CIGARS

This is a continuation of application Ser. No. 897,672 filed Apr. 19, 1978, now abandoned.

It is known that cigars are manufactured in two stages. The core which is made of tobacco leaf fragments is wrapped in a strip of natural tobacco leaf, or restored tobacco, which is called under-wrapper. The unit so formed, or cigar bunch, is thereafter wrapped in a strip of natural tobacco leaf which is called the wrapper.

The face of the wrapper leaf, where the ribs are protruding, is generally placed inside so that the ribs are as little apparent as possible. At the least, the positioning of this face has to be controlled. The wrapper is wrapped in spiral so that the secondary ribs are parallel to the cigar axis, once the cigar is completed.

For reaching this result, one uses normally (due to the obliqueness of the secondary ribs relative to the main rib or "mid-rib"), for wrapping the cigars two symmetrical machines according to whether wrappers cut out from right half leaves or from left half leaves have to be used. The concept of right and of left for the direction of the half leaf or of the wrapper is defined when looking at the leaf according to its natural position on the plant, viz, with its point upwards and the ribs protruding behind.

It has been known for long how to store wrappers or under-wrappers for pre-cut cigars on a support band, or between the turns of a support band wound as a spool, in order to use it later to feed cigar manufacturing machines.

Due to the symmetrical construction of the cigar wrapping machines, such spools carry either wrappers from right half leaves or wrappers from left half leaves. It was only necessary to control that the wrappers were all presented in identical manner, their ribs protruding on the same side of a plane.

However, in French Pat. No. 77 09 864, the Applicant has described a wrapping process allowing wrapping cigars on one same machine from strips indifferently cut in a left half leaf or in a right half leaf, by playing in particular with the rotation direction of the wrapping cradle rollers of the machine in order to obtain a cigar correctly presented (the ribs being always substantially parallel to the cigar axis and protruding towards the bunch), whatever the half leaf from which the wrapper has been taken.

Within the scope of said wrapping process, there are only advantages to use a support band containing at the same time right wrappers and left wrappers: then, it is only necessary to maintain a balance between the proportion of right wrappers and left wrappers on the one hand, and right machines and left machines on the other hand.

Yet, and even if the band feeds with right wrappers and left wrappers either several right machines and left machines, or a standardized machine, one has to determine for each wrapper if it is a right wrapper or a left wrapper: this is indispensable for using them in a correct manner.

This is the target aimed at by the invention, the object of which is, in this respect, a wrapper distributing support band for cigars, on which the "right" wrappers present a face of the tobacco leaf which is the reverse of that presented by the "left" wrappers. According to this presentation, the ribs which, according to the origin of the wrappers, are either in contact with the upper portion of the support band, or protruding, appear substantially parallel to each other. It is then possible to use directly on the same machine all the wrappers stored according to the teachings of the hereabove patent. It is also possible, from the same band, to feed two "right" machines (or two "left" machines) the cradles of which rotate in reverse directions, the wrappers being switched towards one or the other machine according to the face of the leaf which they display.

It is finally possible to foresee to use such a band either for a "right" wrapping machine, or for a "left" wrapping machine. The wrappers intended for one of the two machines are then transferred by simple translation movements in their plane, whereas those intended for the other machine effect a further turning over of their plane along the axis of symmetry.

In order to facilitate the use of such a band, it is possible to provide a mark indicating on which face of the leaf comes the apparent face of a wrapper. The mark may only concern the wrappers coming only from one of the leaf faces. In a further modality, the mark is provided on each wrapper which is different from the preceding one as regards its origin. A mark may be applied in the vicinity of the concerned wrapper or on the wrappers the ribs of which are apparent. When the mark, or index, is applied on the wrapper, it is appropriate that the portion bearing said mark be removed in the final phase of the cigar manufacture, or that it is placed in such manner that the mark applied is not distinguishable by the consumer and does not influence the tasting conditions.

Actually, two particular areas may be distinguished on the cigar wrapper. One of them extends along the wrapper and is the overlapping area of a portion of the following turn after wrapping. The other is situated along the smaller end of the wrapper corresponding to the cigar head, once finished.

Therefore, the marking will be advantageously applied on the wrapper in the area common to the head portion of the wrapper and the overlapping area of said wrapper after wrapping; the common area is in principle removed, or when the removal is not performed, the mark will not be distinguishable.

The exact boundary of this area is explained as a function of two kinds of markings used: either a perforation with removal of material, or stamping of a spot made of an opaque substance.

In fact, it is clear that is it not possible, at random, to effect such a marking on any point of the wrapper. By perforating the wrapper in any indiscriminate point, a prejudice is caused to the normal tasting conditions of the finished cigar by modifying its draught: when manufacturing cigars, the perforated wrappers are always discarded. To lay an opaque substance on the cigar wrapper (even on the face which will not be apparent once the cigar is completed) is risking to be prejudicial to the outer appearance of the cigar, since the spot could be detected by the consumer.

It could have been considered to effect the marking in some point of the overlapping area: the double thickness of the wrapper closes the hole and makes the spot indistinguishable. But this area is relatively narrow and in this case it is necessary to operate with great accuracy since there is the risk to step out of said area to cause again the disadvantages mentioned in the preceding paragraph.

It could have been also possible to consider effecting said marking in the area situated along the smaller side of the wrapper, corresponding to the cigar base once completed. This area is a portion which is removed during the so-called "trimming" operation which gives to the cigar base a neat appearance.

However, it is not possible to effect a marking operation in this area since, during the wrapping operation, it is in this area that the wrapper is seized and starts to be wound the cigar bunch. In order to provide a good wrapping, this area has to be neat and intact in order to provide a good hold.

As regards the area situated along the smaller side of the wrapper corresponding to the cigar head where the wrapping is completed, the disadvantage is of the same nature as for the overlapping area: the necessary accuracy and the risk of overlapping. However, said disadvantage is reduced in the case of a perforation since it is the cigar head which the smoker puts in his mouth.

But the aforementioned disadvantages will be practically removed by using the area which is common to the head portion of the wrapper and to the overlapping portion of said wrapper after gluing; the use of said area causes no difficulties.

In open head cigars, the portion so marked will be discarded when finishing the cigar, and all the more so that it forms the end portion of the wrapper relative to the cigar.

As regards the closed head cigars, the laying of the wrapper which is folded several times over itself on the cigar head hides the perforation or the spot. Moreover, the smoker cuts away himself this portion of the head when he wishes to smoke such a cigar.

The marking may be a perforation with removal of material, performed in the wrapper; said perforation is made in the area defined hereabove. By proceeding in this way, one causes a spot to appear on the wrapper which is formed by the support on which is placed the wrapper the colour of which is different from that of the latter.

The marking may also consist in a deposit on the wrapper, always in the area defined hereabove, of a spot of an opaque substance the luminous radiation of which is different from that of the wrapper. The nature of the substance is indifferent, but it should always comply with the requirements of the legislation in force on additives used in tobacco products. Said substance, taking in account the imperatives connected with the production capacity, should dry up quickly. As an example, one may use an aqueous solution of a food polymer (collagen) to which has been added calcium carbonate.

Said marks may be used for identification of the wrappers, by using the difference between the luminous intensity of said mark and that of the wrapper or the support on which it lays for controlling, when need be, the subsequent manufacturing stage, in particular in an automated manufacture.

In order to read the information supplied by said marks and automatically control, in the required direction, the rotation of the cradles of the wrapping device in such manner that the protrusion of the ribs is always hidden in the cigars, one may install, before the wrapping device, a photo-electric device controlling the marking area on the wrapper before its arrival to the cradles.

If the wrapper is not marked, the photo-electric device which scans the whole area involved, and is honest, will not record any colour difference.

In the contrary, if the wrapper has been marked either with a perforation or by a spot of a white or opaque substance, the photo-electric device will record a luminous intensity difference between the wrapper colour which is naturally dark and that of the mark formed either by the deposit of an opaque or white substance, or by the perforation made in the wrapper which allows seeing the support of said wrapper which is of a lighter colour.

It is obvious that if there are available, in use, means for detecting which is the face of the exposed leaf, that is, whether the ribs are or are not protruding, said marks may be omitted. The exact position of the wrapper may be in all cases detected independently from any marking, for instance optically.

In a by no way limitative example, there has been shown in the single FIGURE of the appended drawing the support band according to the invention in the form of a spool formed by winding the support band on itself.

In this example, the spool comprises a mandrel 1 on which is wound a band 2 provided with fine perforations or made of a substance pervious to air.

The width of this band is larger than the length of the wrappers C laid on it.

On the selvage portion of the band are applied marks 3 opposite wrappers $C_1$ and $C_2$. Said marks, which may be detectable by any known system (such as a photoelectric or an electromagnetic device) are different according to whether they point out a wrapper from a right half leaf or a wrapper from a left half leaf.

They may also be attributed to only one mode of presentation of the wrappers, the absence of signal pointing out the other mode.

In order to form such a roll, a band 2 is brought forward, either continuously or step by step, in the direction of arrow F. Simultaneously, the operative who has at her disposal a homogeneous pile of full tobacco leaves all laid in the same direction (petiole on the right or on the left according to the direction of the cutting form) removes on one side of the leaf main rib the maximum quantity of wrappers $C_1$. Each wrapper is transferred by a known means such as a sucking head, to the band 2. A mark is simultaneously applied in the selvage portion of the band opposite each of them. The she turns the leaf over face for face and cuts in the second half leaf as many wrappers $C_2$ as possible. Each wrapper is transferred in the same manner on band 2. However, the exposure of said wrappers $C_2$ being different (the ribs being then for instance far less visible), the corresponding mark will be applied on the other selvage. Simultaneously, the band that carries the wrappers is being wound on a mandrel.

When using said spool with a single cigar manufacturing machine, the spool is being unwound in reverse direction to arrow F. The signal initiated by the mark indicating the origin of the wrapper provides the possibility of starting at the right moment the removal of said wrapper and to adjust the direction of rotation of the wrapping cradle rollers. The wrapper is then transferred to the machine and wrapped about a cigar bunch. The changing of signal causes inversion of the rotation direction of the rollers and the wrapping in reverse direction of the new wrapper about another bunch.

When this spool is used on a wrapping machine which requires usually wrappers out on a reverse machine (for instance a left cutting form used on a right wrapping machine), the wrappers are for instance being reversed in their plane: with assistance of an endless band which takes over the wrapper on its lower strand and returns it to the wrapping machine on its upper strand.

One establishes, when manufacturing such support bands, or distributing rolls, a considerable gain of time as against the manufacture of similar bands or rolls from stripped half leaves, taking in account the time necessary for stripping and distributing the half leaves to different cutting stations. One establishes also an important gain of material due not only to the avoidance of losses of leaf tissue during stripping, but also to the handling simplifications: said simplifications reduce substantially the appearance and/or aggravation of lacerations in the leaves.

What we claim is:

1. A method for forming a spool for storing wrappers of tobacco leaves for subsequent use in feeding cigar manufacturing machines, the spool comprising a support band wound on itself and having the wrappers interleaved therein, the wrappers being formed from left half leaves and right half leaves of tobacco as defined when looking at the tobacco leaf with its point upward and its ribs protruding behind, the method comprising the following steps:

(a) cutting the maximum quantity of wrappers from one of said tobacco leaves, such cutting being carried out to the side of the leaf main rib which defines said left half leaves;

(b) transferring the left wrappers to the support band successively while winding the support band on itself with interleaved left wrappers until said maximum quantity of left wrappers is wound into the support band;

(c) turning the tobacco leaf from step (a) over face for face;

(d) cutting the maximum quantity of right wrappers from tobacco leaves by cutting from the side of the leaf main rib which defines said right half leaves of turned leaf from step (c);

(e) transferring the right wrappers from step (d) to the support band successively while winding the support band on itself with interleaved right wrappers until said maximum quantity of right wrappers is wound into the support band; and (f) unwinding the spool for feeding said cigar manufacturing machines, whereby the face of the tobacco leaf presented by the right wrappers is the reverse of the face of the tobacco leaf presented by the left wrappers.

2. The method of claim 1 wherein said support band has a selvage portion, and step (b) further includes applying a mark in the selvage portion of the band opposite each of said left wrappers, whereby said marks indicate the origin of said left wrappers.

3. The method of claim 1 wherein said support band has a selvage portion and step (e) includes applying a mark in the selvage portion of the band opposite each of said right wrappers, whereby said marks indicate the origin of said right wrappers.

4. The method of either claim 2 or 3, wherein said cigar manufacturing machines include rotatable wrapping cradle rollers, and step (f) includes adjusting the direction of rotation of the wrapping cradle rollers so that as said spool is unwound, those wrappers having a mark in the selvage portion of the support band are fed into the machine in the reverse direction from those wrappers not having a mark in the selvage portion of the support band.

5. The method of claim 2 or 3, wherein said cigar manufacturing machines include an endless band for reversing wrappers in their plane, and step (f) includes feeding only those wrappers having a mark in the selvage portion of the support band to the endless band for reversing only those wrappers having a mark in the selvage portion adjacent thereto.

6. The method of claim 1, wherein said support band is wound on itself in step (b) continuously, and wherein said support band is wound on itself in step (e) continuously.

7. The method of claim 1, wherein said support band in step (b) is wound on itself step by step, and wherein said support band in step (e) is wound on itself step by step.

8. The method of claim 1, wherein step (b) includes marking the face of said left wrapper.

9. The method of claim 1, wherein step (e) includes marking the face of said right wrapper.

10. The method of claim 8 or 9, wherein said marking is made by perforating said wrapper with removal of material from the wrapper.

11. The method of claim 8 or 9, wherein said mark results from applying a spot of an opaque substance on said wrapper, luminous radiation of said substance being different from that of said wrapper.

* * * * *